United States Patent [19]

Williams et al.

[11] Patent Number: 4,519,666

[45] Date of Patent: May 28, 1985

[54] TRIAXIAL ELECTRICAL CONNECTOR

[75] Inventors: Robert L. Williams, Bainbridge; Christopher Marks, Guilford, both of N.Y.

[73] Assignee: Allied Corporation, Morristown, N.J.

[21] Appl. No.: 523,481

[22] Filed: Aug. 15, 1983

[51] Int. Cl.[3] ..... H01R 17/18

[52] U.S. Cl. ..... 339/177 R; 339/276 R; 339/214 R; 339/275 B; 29/879

[58] Field of Search ..... 339/177, 17 LC, 143, 339/214, 147; 29/879

[56] References Cited

U.S. PATENT DOCUMENTS

| | | | |
|---|---|---|---|
| 2,238,319 | 4/1941 | Goldfield | 339/177 R |
| 2,461,268 | 2/1949 | Goldfield | 339/177 R |
| 2,702,376 | 2/1955 | Brush | 339/177 E |
| 3,065,525 | 11/1962 | Ingraham et al. | 333/147 P |
| 3,094,365 | 6/1963 | Chamberlain et al. | 339/143 R |
| 3,245,030 | 4/1966 | D'Amico | 339/317 |
| 3,541,495 | 11/1970 | Ellis et al. | 339/177 |
| 3,845,450 | 10/1974 | Cole et al. | 339/42 |
| 4,034,471 | 7/1977 | Bias | 29/629 |
| 4,189,204 | 2/1980 | Brown et al. | 339/275 R |
| 4,280,749 | 7/1981 | Cole et al. | 339/177 R |

FOREIGN PATENT DOCUMENTS

| | | | |
|---|---|---|---|
| 56-40455 | 8/1981 | Japan | 339/17 LC |

*Primary Examiner*—Gil Weidenfeld
*Assistant Examiner*—David L. Pirlot
*Attorney, Agent, or Firm*—C. D. Lacina; R. J. Eifler

[57] ABSTRACT

The invention is a method for mounting tubular electrical conductors (10, 20) of a triaxial connector to the connector housing and the connector thus formed (1) and is characterized by a plurality of electrically conducting terminals (40) that have an annular groove (41) therein that mate with a respective notch (13) in the respective tubular conductors (20, 30). The other end of each terminal (40) is connected to the housing (1) by a plastic potting compound (50).

4 Claims, 5 Drawing Figures

FIG. 1
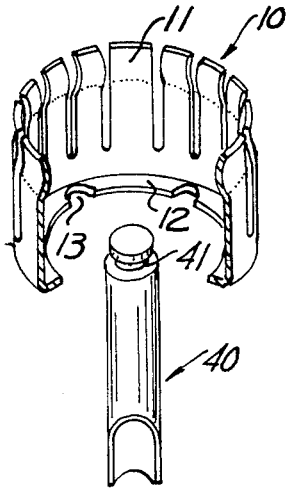
FIG. 2
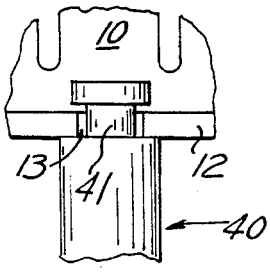
FIG. 3
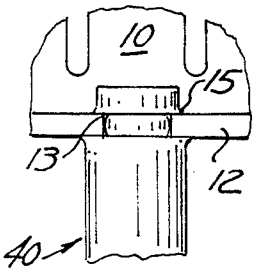
FIG. 4
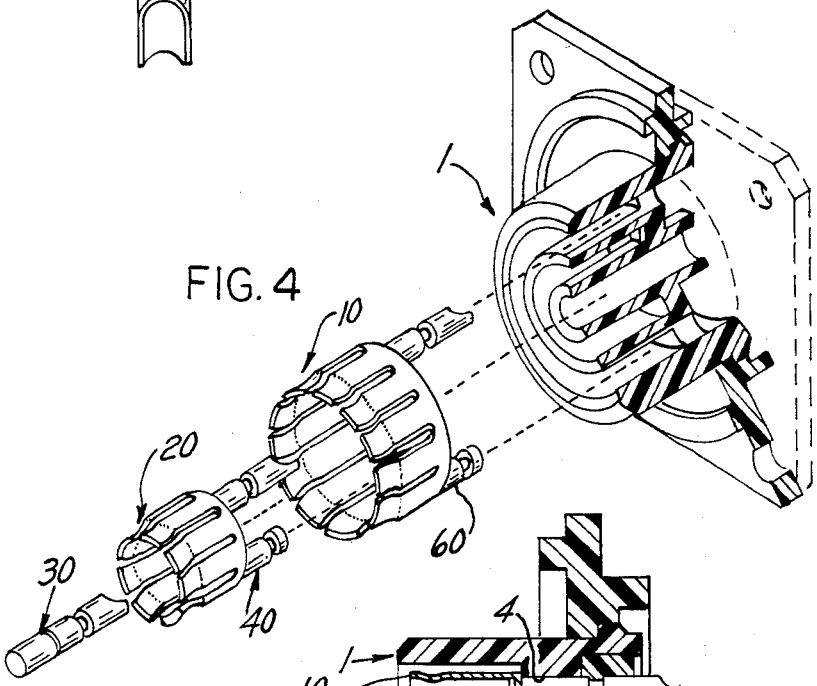
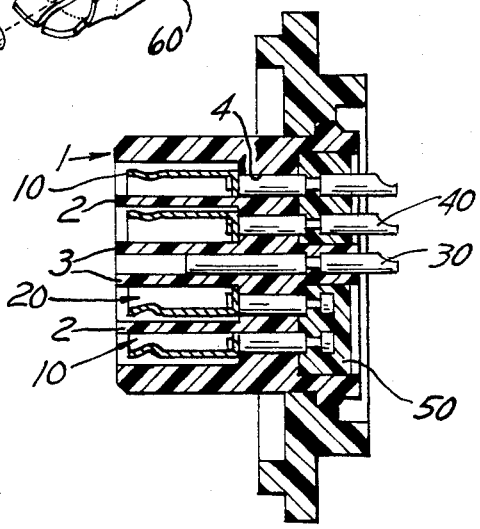
FIG. 5

TRIAXIAL ELECTRICAL CONNECTOR

This invention relates to a triaxial electrical connector and in particular the mounting of the tubular contacts of the connector to the connector housing.

Triaxial electrical connectors generally include two tubular electrical conductors and a center conductor, all concentrically mounted and electrically isolated from each other within a housing. The tubular conductors each have a radially inwardly extending lip that includes one or more notches therein that receive a metal terminal. The forward end portion of each terminal was then deformed against the surface of the lip, while the other end of each terminal extended through a passage in the housing and was held in place by a potting compound poured into the housing. This mechanically connected the terminals and hence the conductors to the housing. However, such an arrangement often resulted in a loose connection between the conductors and terminals which resulted in an unreliable electrical connection.

DISCLOSURE OF THE INVENTION

This invention provides a method and apparatus for obtaining a good mechanical and electrical connection between the forward mating portion and the rear terminal portion of an electrical contact within a triaxial connector.

The invention is characterized by electrically conductive terminal having a forward end portion that includes an annular groove therein that is located in a notch in a radial lip of a tubular conductor. The end of each terminal is struck to deform the walls of the groove around the lip to mechanically connect the terminal to the lip. The other end of the terminal extends through a passage in the housing and is connected to the housing by a potting compound. Preferably, the terminal is presoldered so that when the connection between the terminal and conductor is heated the connection is soldered together.

One advantage of the invention is that it provides a reliable electrical connection between the terminal portion and mating portion of a contact for a triaxial connector.

Another advantage of the invention is that the presoldering of the terminal before connecting it to the conductor eliminates manual soldering and permits automated soldering by reflow of the solder after the connection is made.

DETAILED DESCRIPTION OF THE INVENTION

FIG. 1 illustrates the tubular mating portion and the rear terminal portion of a contact for a triaxial connector.

FIGS. 2 and 3 illustrate how the terminal portion is mechanically connected to the tubular mating portion of the contact.

FIG. 4 is an exploded view of the triaxial electrical connector.

FIG. 5 is a cutaway view of a triaxial electrical connector incorporating the principles of this invention.

Referring now to the drawings, FIG. 1 illustrates an electrical contact generally comprised of a gold plated copper alloy. The contact includes a tubular conductor 10 having a forward mating portion that includes a plurality of spring fingers 11 that are resiliently and radially deflectable. The tubular conductor 10 also includes a radially inwardly extending lip 12 having one or more notches 13 therein. A cylindrically shaped electrically conductive terminal 40 has an annular groove 41 that is adapted to engage the notch 13 of the tubular conductor 10.

FIG. 2 illustrates the groove 41 in the cylindrical conductor 40 located in a notch 13 in the lip 12 of the tubular member 10. As seen in FIG. 3, after locating the groove of the cylindrical conductor 40 in the notch, the cylindrical conductor 40 is mechanically connected to the lip 12 of the tubular member 10 by striking the cylindrical conductor 40 so that the upper and lower faces of the groove captivate the lip 12 of the tubular conductor 10. After this is accomplished, the tubular conductor 40 is soldered 15 to the lip 12 of the tubular conductor 10. Preferably, this is accomplished by applying solder to the end portion of the cylindrical conductor 40 before it is connected to the lip 12 of the tubular conductor 12. Thus, after the connection is made the connection can be heated to melt the solder and assure an excellent electrical connection.

FIG. 4 is an exploded view of a triaxial electrical connector incorporating the principles of the invention. The triaxial electrical connector includes an electrically nonconducting housing 1, first and second tubular conductors 10 and 20, a center conductor 30 and a plurality of cylindrical conductors 40 connected to respective tubular conductors. The nonconducting housing includes integral therewith, first and second tubular insulators 2, 3 to isolate the tubular conductors 20, 30 and the center conductor 30 from each other.

FIG. 5 illustrates a cutaway view of a triaxial electrical connector. This view illustrates how the cylindrical conductors or terminals 40 are each connected to a respective tubular conductor 20 or 30 and the housing 1. The terminals 40 extend through passages 4 in the rear end of the housing 1 and into a void portion of the housing 1 which is filled with a potting compound 50 to mechanically connect the cylindrical conductors 40 to the housing 1. At least one terminal 40 attached to a respective tubular conductor 20 and 30 extends beyond the potting compound for connection to electrical wires (not shown) to provide appropriate electrical connections to the tubular conductors 20 and 30.

Having described the invention what is claimed is:

1. In combination with a triaxial electrical connector of the type having an electrical nonconducting housing having a plurality of axially extending passages therein; a first tubular electrical conductor having a plurality of spring fingers at one end and a radially extending lip at the other end thereof, said lip having at least one notch; a second tubular electrical conductor located coaxially within and spaced from the first tubular electrical conductor; a center electrical conductor mounted coaxially of and spaced from said first and said second tubular electrical conductors; and a means for mounting said conductors within said housing, the improvement wherein said means for mounting said conductors within said housing comprises:

a plurality of electrically conductive terminals each having a forward end portion that includes an annular groove, a portion of each annular groove being located in a respective notch in one of said first and second tubular electrical conductors, each said terminal being plastically deformed locally of its groove and about its notch so as to be mechanically connected to the lip of a respective tubular electrical conductor, a rearward end portion of each said terminal extending through a respective axial passage in said housing; and a potting material comprised of an electrically non-conductive material being disposed in a rear portion of said housing for mechanically connecting the rearward end portion of each said terminal within the housing.

2. The combination as recited in claim 1 wherein solder is applied around the mechanical connection between the terminals and the lip of the tubular electrical conductor.

3. The combination as recited in claim 1 wherein first and second tubular insulating members are integrally formed with said housing, each said insulating member being positioned to extend respectively between the first and second tubular electrical conductors and between the second tubular electrical conductor and said center conductor.

4. The combination as recited in claim 3 wherein solder is applied around the mechanical connection between the terminals and the lip of the tubular electrical conductor.

* * * * *